US009257001B2

(12) United States Patent
Angell et al.

(10) Patent No.: US 9,257,001 B2
(45) Date of Patent: Feb. 9, 2016

(54) INTEGRATED GAMING AND SERVICES SYSTEM AND METHOD

(75) Inventors: Robert C. Angell, West Greenwich, RI (US); Edward J. Hole, Portsmouth, RI (US); Susan K. Kesel, Oneida, NY (US)

(73) Assignee: Oneida Indian Nation, Oneida, NY (US)

( * ) Notice: Subject to any disclaimer, the term of this patent is extended or adjusted under 35 U.S.C. 154(b) by 1415 days.

(21) Appl. No.: 11/706,970

(22) Filed: Feb. 16, 2007

(65) Prior Publication Data

US 2007/0207857 A1 Sep. 6, 2007

Related U.S. Application Data

(60) Provisional application No. 60/773,635, filed on Feb. 16, 2006.

(51) Int. Cl.
*A63F 9/24* (2006.01)
*G07F 17/32* (2006.01)

(52) U.S. Cl.
CPC ..... *G07F 17/3209* (2013.01); *G07F 17/32* (2013.01); *A63F 2009/247* (2013.01)

(58) Field of Classification Search
USPC ..... 463/29, 30, 36, 40, 42, 31, 32
See application file for complete search history.

(56) References Cited

U.S. PATENT DOCUMENTS 4,240,635 A 12/1980 Brown
4,283,709 A 8/1981 Lucero et al.
4,335,809 A 6/1982 Wain
4,339,798 A 7/1982 Hedges et al.
4,359,631 A 11/1982 Lockwood et al.
4,467,424 A 8/1984 Hedges et al.
4,494,197 A 1/1985 Troy et al.

(Continued)

FOREIGN PATENT DOCUMENTS

EP 0 769 769 A1 4/1997
WO WO 89/06998 8/1989

(Continued)

OTHER PUBLICATIONS

Pot-O-Gold, 19" Touchscreen Multi-Game Terminal Toucheasy Keno© Play Description (2 pages).

(Continued)

*Primary Examiner* — Paul A D'Agostino
*Assistant Examiner* — Brandon Gray
(74) *Attorney, Agent, or Firm* — DeLizio Law, PLLC

(57) ABSTRACT

An integrated gaming and services system is disclosed. The system includes a gaming terminal and a server system. The gaming terminal may include a reader system connected to the gaming terminal, the reader system configured to read identification information of a player. The gaming terminal may further include an input/output system including one or more input components that permit a player to input at least voice commands to the gaming terminal, and one or more output components that output gaming and services information to the player in response to the voice commands. The gaming terminal may additionally include a communication interface connecting the gaming terminal to a communication network. The server system communicates with the gaming terminal via the communication interface, and provides enhanced services to the player based at least on the identification information of the player.

18 Claims, 5 Drawing Sheets

(56) References Cited

U.S. PATENT DOCUMENTS

| | | | | |
|---|---|---|---|---|
| 4,575,622 | A | 3/1986 | Pellegrini | |
| 4,636,951 | A | 1/1987 | Harlick | |
| 4,648,600 | A | 3/1987 | Olliges | |
| 4,669,730 | A | 6/1987 | Small | |
| 4,760,527 | A | 7/1988 | Sidley | |
| 4,815,741 | A | 3/1989 | Small | |
| 4,842,278 | A | 6/1989 | Markowicz | |
| 4,856,787 | A | 8/1989 | Itkis | |
| 4,880,237 | A | 11/1989 | Kishishita | |
| 4,882,473 | A | 11/1989 | Bergeron et al. | |
| 4,926,327 | A | 5/1990 | Sidley | |
| 4,994,908 | A | 2/1991 | Kuban et al. | |
| 5,038,022 | A | 8/1991 | Lucero | |
| 5,069,453 | A | 12/1991 | Koza et al. | |
| 5,119,295 | A | 6/1992 | Kapur | |
| 5,159,549 | A | 10/1992 | Hallman, Jr. et al. | |
| 5,179,517 | A | 1/1993 | Sarbin et al. | |
| 5,197,094 | A | 3/1993 | Tillery et al. | |
| 5,223,698 | A | 6/1993 | Kapur | |
| 5,259,613 | A | 11/1993 | Marnell, II | |
| 5,265,874 | A | 11/1993 | Dickinson et al. | |
| 5,276,312 | A | 1/1994 | McCarthy | |
| 5,287,269 | A | 2/1994 | Dorrough et al. | |
| 5,297,802 | A | 3/1994 | Pocock et al. | |
| 5,324,035 | A | 6/1994 | Morris et al. | |
| 5,326,104 | A | 7/1994 | Pease et al. | |
| 5,332,076 | A | 7/1994 | Ziegert | |
| 5,371,345 | A | 12/1994 | LeStrange et al. | |
| 5,408,417 | A | 4/1995 | Wilder | |
| 5,429,361 | A | 7/1995 | Raven et al. | |
| 5,470,079 | A | 11/1995 | LeStrange et al. | |
| 5,505,449 | A | 4/1996 | Eberhardt et al. | |
| 5,524,888 | A | 6/1996 | Heidel | |
| 5,581,461 | A | 12/1996 | Coll et al. | |
| 5,586,937 | A | 12/1996 | Menashe | |
| 5,611,730 | A | 3/1997 | Weiss | |
| 5,613,912 | A | 3/1997 | Slater | |
| 5,655,961 | A | 8/1997 | Acres et al. | |
| 5,674,128 | A | 10/1997 | Holch et al. | |
| 5,722,890 | A | 3/1998 | Libby et al. | |
| 5,732,398 | A | 3/1998 | Tagawa | |
| 5,755,621 | A | 5/1998 | Marks et al. | |
| 5,761,647 | A | 6/1998 | Boushy | |
| 5,762,552 | A | 6/1998 | Vuong et al. | |
| 5,770,533 | A | 6/1998 | Franchi | |
| 5,797,794 | A | 8/1998 | Angell | |
| 5,800,269 | A | 9/1998 | Holch et al. | |
| 5,823,879 | A | 10/1998 | Goldberg et al. | |
| 5,830,067 | A | 11/1998 | Graves et al. | |
| 5,830,068 | A | 11/1998 | Brenner et al. | |
| 5,830,069 | A | 11/1998 | Soltesz et al. | |
| 5,836,817 | A | 11/1998 | Acres et al. | |
| 5,857,911 | A | 1/1999 | Fioretti | |
| 5,871,398 | A | 2/1999 | Schneier et al. | |
| 5,917,725 | A | 6/1999 | Thacher et al. | |
| 5,919,091 | A | 7/1999 | Bell et al. | |
| 5,949,411 | A | 9/1999 | Doerr et al. | |
| 5,971,271 | A | 10/1999 | Wynn et al. | |
| 5,971,849 | A | 10/1999 | Falciglia | |
| 5,984,779 | A | 11/1999 | Bridgeman et al. | |
| 6,024,640 | A | 2/2000 | Walker et al. | |
| 6,039,648 | A | 3/2000 | Guinn et al. | |
| 6,048,269 | A | 4/2000 | Burns et al. | |
| 6,049,823 | A | 4/2000 | Hwang | |
| 6,089,982 | A | 7/2000 | Holch et al. | |
| 6,093,100 | A | 7/2000 | Singer et al. | |
| 6,101,477 | A | 8/2000 | Hohle et al. | |
| 6,110,041 | A | 8/2000 | Walker et al. | |
| 6,113,495 | A | 9/2000 | Walker et al. | |
| 6,120,024 | A | 9/2000 | Lind | |
| 6,183,366 | B1 | 2/2001 | Goldberg et al. | |
| 6,264,560 | B1 | 7/2001 | Goldberg et al. | |
| 6,270,410 | B1 * | 8/2001 | DeMar et al. | 463/20 |
| 6,280,326 | B1 | 8/2001 | Saunders | |
| 6,280,328 | B1 | 8/2001 | Holch et al. | |
| 6,319,125 | B1 | 11/2001 | Acres | |
| 6,322,446 | B1 | 11/2001 | Yacenda | |
| 6,347,086 | B1 | 2/2002 | Strachan | |
| 6,358,151 | B1 | 3/2002 | Enzminger et al. | |
| 6,383,078 | B1 | 5/2002 | Yacenda | |
| 6,394,907 | B1 * | 5/2002 | Rowe | 463/42 |
| 6,402,614 | B1 * | 6/2002 | Schneier et al. | 463/17 |
| 6,409,602 | B1 * | 6/2002 | Wiltshire et al. | 463/42 |
| 6,471,590 | B2 | 10/2002 | Saunders | |
| 6,508,709 | B1 | 1/2003 | Kamarkar | |
| 6,846,238 | B2 * | 1/2005 | Wells | 463/39 |
| 7,022,017 | B1 | 4/2006 | Halbritter et al. | |
| 7,128,652 | B1 | 10/2006 | Lavoie et al. | |
| 2001/0003100 | A1 | 6/2001 | Yacenda | |
| 2002/0028709 | A1 | 3/2002 | Finer et al. | |
| 2002/0077178 | A1 | 6/2002 | Oberberger et al. | |
| 2002/0166126 | A1 | 11/2002 | Pugh et al. | |
| 2003/0027631 | A1 | 2/2003 | Hedrick et al. | |
| 2003/0054868 | A1 | 3/2003 | Paulsen et al. | |
| 2003/0100371 | A1 | 5/2003 | Gatto et al. | |
| 2003/0227892 | A1 * | 12/2003 | Cabana | 370/338 |
| 2004/0084524 | A1 | 5/2004 | Ramachandran | |
| 2004/0121841 | A1 | 6/2004 | Xidos et al. | |
| 2004/0147313 | A1 | 7/2004 | Stanley et al. | |
| 2004/0204231 | A1 * | 10/2004 | Martin et al. | 463/25 |
| 2005/0101383 | A1 | 5/2005 | Wells | |
| 2005/0239546 | A1 * | 10/2005 | Hedrick et al. | 463/29 |
| 2007/0021198 | A1 * | 1/2007 | Muir et al. | 463/29 |
| 2008/0108433 | A1 * | 5/2008 | DiMichele et al. | 463/40 |

FOREIGN PATENT DOCUMENTS

| | | |
|---|---|---|
| WO | WO 95/30944 | 11/1995 |
| WO | WO 01/76710 A2 | 10/2001 |
| WO | WO 03/045517 A1 | 5/2003 |

OTHER PUBLICATIONS

Pot-O-Gold, 19" Touchscreen Multi-Game Terminal Superpick Lotto© Play Description (2 pages).

Pot-O-Gold, 19" Touchscreen Multi-Game Terminal Touch 6 Lotto© Play Description (2 pages).

Pot-O-Gold, 19" Touchscreen Multi-Game Terminal Touch 6 Lotto© Technical Description (1 page).

Pot-O-Gold, 19" Touchscreen Multi-Game Terminal Supergold Bingo© Play Description (2 pages).

Casinolink, Mikohn Worldwide (4 pages).

Casinolink System, Mikohn WorldWide (8 pages).

Casino Systems Solutions, IGT International Game Technology (20 pages), Mar. 19, 1997.

QuickTrack, Quick Track Gaming, Inc. (43 pages).

Oasis II, CDS Systems and Services (9 pages).

The Future of Gaming Today, Casino Data Systems (7 pages).

CDS Video Slant Top, Casino Data Systems (6 pages).

SafeJack, Mikohn WorldWide (15 pages).

Instant Keno Specification; multiple drafts captioned "Keno" and "Instant Keno" undated (38 pages).

Imagineering Systems, Inc., "Instant Keno—Cashless Automated Keno Writer Stations" undated (6 pages).

Imagineering Systems, Inc., "The Keno People" undated (2 pages).

Bruce T. Samboy letter to Hon. Richard F. Corbisiero, Jr., dated Jun. 1, 1994, "Review of Instant Keno" (6 pages).

Bruce T. Samboy letter to Carl Conti dated Jun. 13, 1994, re review of Instant Keno game (2 pages).

Bruce T. Samboy letter to Hon. Richard Corbisiero, Jr., dated Jun. 14, 1994, "Recommendations Concerning Instant Keno" (7 pages).

Katherine A. Smith letter to Hon. James R. Hurley dated Jun. 15, 1994, "Imagineering Computerized Keno System" (4 pages).

Jacqueline L. Minder letter to Ron Mach dated Jun. 20, 1994, re Gaming Enforcement's report (1 page).

Imagineering Systems, Inc., letter to Bruce T. Samboy dated Jun. 27, 1994 (2 pages).

Bruce T. Samboy letter to Carl Conti dated Jul. 1, 1994, "Imagineering—Instant Keno and Gaming Enterprise Registration" (2 pages).

(56) References Cited

OTHER PUBLICATIONS

Niels C. Holch letter to Hon. Richard F. Corbisiero, Jr., dated Jul. 12, 1994 (1 page).
Hon. Richard F. Corbisiero, Jr., letter to Niels C. Holch dated Jul. 14, 1994 (1 page).
"High-Tech Gambling Debuts at Turning Stone," Syracuse Post Standard, Feb. 27, 1995 (1 page).
Turning Stone Inter-Office Memorandum to Bong Woo from Susan Gatley dated Oct. 17, 1994, re Instant Keno Issues (3 pages).
Michael A. Banks, "America Online: A Graphics-Based Success," Link-UP, Feb. 1992, pp. 12.
Yerak, Becky, "At cashless slots: You've got mail, and a jackpot," USA Today, Nov. 13, 2000 p. 2E (two pages).
Monteau, Harold, National Gaming Indian Commission (1 page).
Harold Monteau letter to Richard M. Milanovich, dated Jun. 6, 1995, "Certain Card games . . ." (2 pages).
Kevin K. Washburn letter to Joseph M. Speck dated Mar. 13, 2001, "WIN Sports Betting." (3 pages).
*AT&T Corp.*v.*Coeur D'Alene Tribe*, 45 F.Supp. 2d 995 (D. Idaho 1998) (23 pages).
S. 692, 106 Congress, 1st Session (17 pages).
H.R. 3125, 106th Congress, 2d Session (17 pages).
"Bill HR 3125 IH. The Internet Gambling Prohibition Art Oct. 21, 1999," Offered by Mr. Goodlatte of Virginia (15 pages).
PCT International Search Report for PCT/US2007/003911, dated Jul. 23, 2007.
PCT Written Opinion of the International Searching Authority for PCT/US2007/003911, dated Jul. 23, 2007.
"CA Application No. 2,642,642 Examiners Report", Jan. 28, 2014 , 2 pages.

* cited by examiner

INTEGRATED GAMING AND SERVICES SYSTEM AND METHOD

RELATED APPLICATIONS

The present disclosure claims priority to U.S. Provisional Patent Application No. 60/773,635 filed Feb. 16, 2006, entitled "Integrated Gaming and Services System," incorporated herein by reference in its entirety.

TECHNICAL FIELD

This invention relates generally to providing an integrated gaming and services system. In particular, the invention relates to providing integrated gaming and services, including resort amenities, Find-a-Friend services, cashless gaming services, expanded games selection, voice-over-network communication, voice-enabled gaming, responsible gaming controls, and other services, at a gaming machine.

BACKGROUND

Most resort venues (e.g. hotel, restaurant, gaming tables) are employee-staffed and offer clear opportunities for staff/guest interaction. In order to differentiate and improve the resort casino customer gaming experience and increase utilization of all resort casino offerings by as many guests as possible, resort personnel must recognize, reach out to, and personalize their service to all guests at all points of contact. However, the nature of gaming (e.g., slot) machines and player terminals, where guests typically interact directly with a machine, limits the opportunities for personalized service. Given the inherent personalized nature of account-based gaming and the potential of applying technology to the gaming floor, including Liquid Crystal Display (LCD) and other graphical display technologies, on-board Network Interface Controllers, and high speed Local Area Network infrastructures (e.g., switches, routers, and CAT5/6 wiring), it is possible to offer enhanced gaming and services to the customer, achieve a greater degree of personalized service, and extend the resort to the customer on the gaming floor.

Furthermore, in order to maintain operation of a gaming terminal by a resort, a gaming terminal typically includes an interface that provides resort personnel access to terminal settings and other information associated with the terminal. For example, resort personnel may disable the terminal, reset the terminal, access play history, change terminal configuration, review terminal accounting data, etc. In many instances terminal access is provided directly from the main screen of the gaming terminal, or through a user interface on a player tracking module screen or a combination of player tracking screen with a keypad that is integrated into the player tracking module.

When a resort employee uses such a user interface, any information displayed on the main screen or the player tracking screen may be visible to bystanders. As a result, players may be able to view proprietary resort information (e.g., hold percentages of the gaming terminal, the amount of net revenue the terminal is earning, etc.). The small screen size and limited keyboard functionality of the player tracking module may additionally restrict the type of interface that can be provided. Furthermore, a player may be positioned in front of the player tracking module or may be using the terminal, which may prevent resort personnel from accessing the terminal.

An alternative approach to an interface for accessing the gaming terminal is a remote access to the terminal through a back office console. This addresses some of the problems discussed above, but additionally requires an employee at the terminal to communicate back to the employee in the back office.

The disclosed systems and methods are directed toward overcoming one or more of the problems set forth above.

SUMMARY

In one aspect, the present disclosure is directed to an integrated gaming and services system. The system includes a gaming terminal and a server system. The gaming terminal includes a reader system connected to the gaming terminal, the reader system configured to read identification information of a player. The gaming terminal further includes an input/output system including one or more input components that permit a player to input at least voice commands to the gaming terminal, and one or more output components that output gaming and services information to the player in response to the voice commands. The gaming terminal additionally includes a communication interface connecting the gaming terminal to a communication network. The server system communicates with the gaming terminal via the communication interface, and provides enhanced services to the player based at least on the identification information of the player. In one embodiment, the system further includes a portable device configured to permit a user to configure and access information from the gaming terminal.

In a further aspect, the present disclosure is directed to a method of providing integrated gaming and services to disabled players. The method includes determining an identification of a player using a gaming terminal based on one or more of: information received from a card, information received from an RFID signal, and biometric information. The method additionally includes receiving, by the gaming terminal, a voice command from the player, and providing, by the gaming terminal, gaming information to the player, in response to the voice command and based at least in part on the determined identification. The method further includes limiting the player's play at the gaming terminal using one or more responsible gaming controls, wherein the responsible gaming controls are based at least in part on the determined identification.

In a further aspect, the present disclosure is directed to a portable device for configuring one or more resort gaming terminals. The portable device includes an input/output system configured to accept instructions from a user, and an interface system configured to communicate the instructions with one or more gaming terminals at the resort. The instructions include one or more of: instructions for accessing information from the one or more gaming terminals, and instructions for configuring the one or more gaming terminals.

DETAILED DESCRIPTION

The following detailed description refers to the accompanying drawings. Although the description refers to exemplary embodiments, other embodiments are possible, and changes may be made to the embodiments described without departing from the spirit and scope of the invention. The following detailed description does not limit the invention. Instead, the scope of the invention is defined by the appended claims and their equivalents.

A number of communication systems for resorts and other gaming environments provide users with enhanced services. Exemplary systems are described in U.S. Pat. No. 7,022,017, issued Apr. 4, 2006, entitled "Interactive Resort Operating System"; U.S. Pat. No. 7,128,652, issued Oct. 31, 2006, entitled "System, Method, and Article of Manufacture for Gaming from an Off-Site Location"; U.S. Patent Application Publication No. 2004/0204231 A1 , published on Oct. 14, 2004, entitled "Cashless Gaming System and Method With Monitoring"; U.S. patent application Ser. No. 11/475,042, filed on Jun. 27, 2006, entitled "Systems and Methods for Providing Communication Services to Guests at a Hospitality Facility"; and U.S. patent application Ser. No. 11/483,558, filed on Jul. 11, 2006, entitled "Method and System for Automated Responsible Gaming Controls," all of which are incorporated herein by reference.

Figure 1:
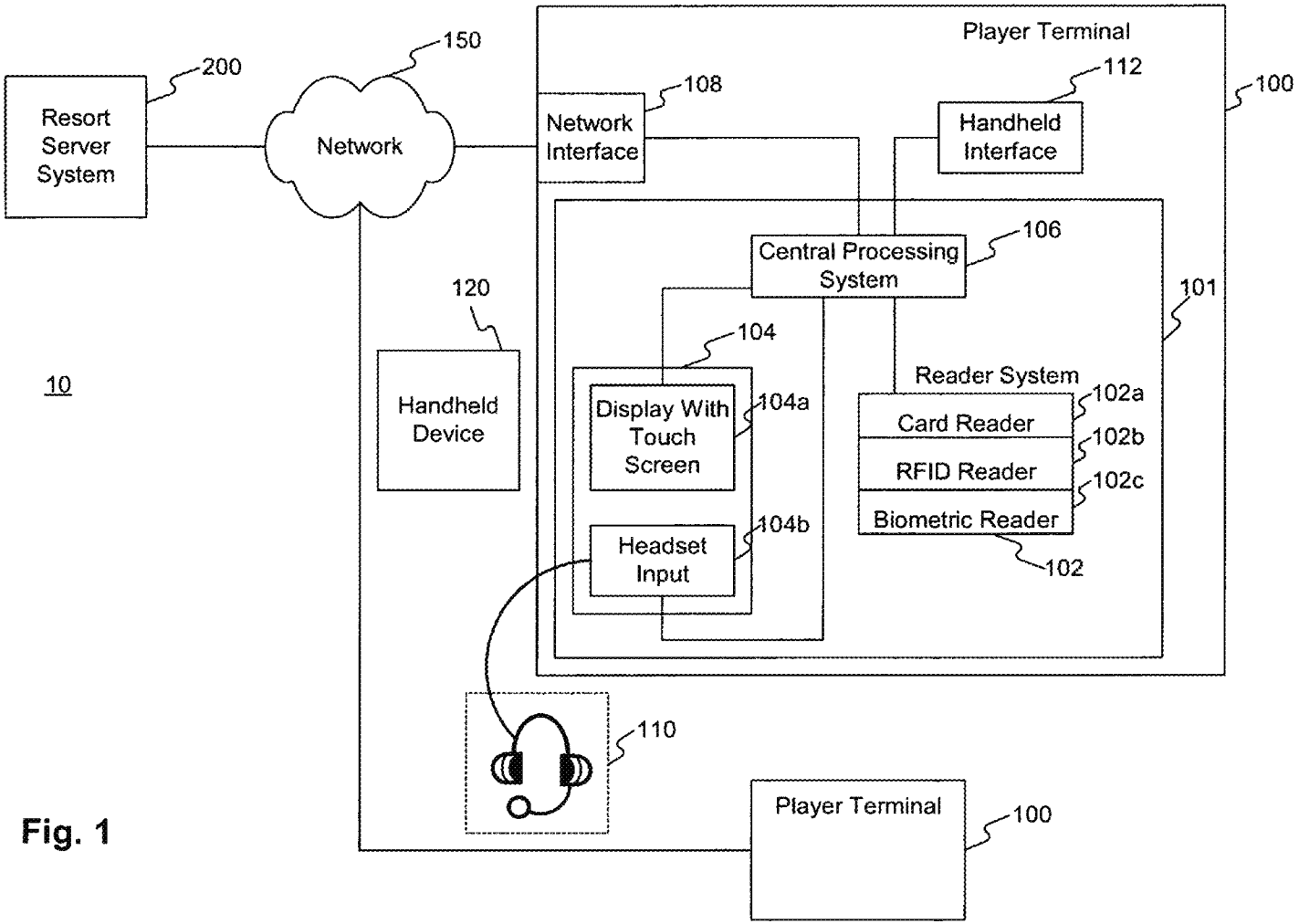
FIG. 1 is an illustration of a system for providing integrated gaming and services consistent with certain embodiments of the present invention.

FIG. 1 is an illustration of a system 10 for providing integrated gaming and services consistent with certain exemplary embodiments. System 10 may include, for example, resort server system 200 coupled to one or more player terminals 100 (e.g., gaming machines) via a network 150. In one embodiment, system 10 additionally includes handheld device 120.

Player terminals 100 may include a number of devices, including a device 101. Device 101 may be part of the player terminal 100, attached to player terminal 100, embedded inside player terminal 100, or coupled to player terminal 100 in some other way. In certain embodiments, device 101 includes one or more components. For example, device 101 may include a reader system 102, an input/output system 104, a central processing system 106, and other components.

Reader system 102 may be used to identify a player and/or to identify information associated with the player. In certain embodiments, reader system 102 may be used to identify a casino employee. In one embodiment, reader system 102 includes one or more sub-components, such as card reader 102*a*, RFID reader 102*b*, and biometric reader 102*c*. Card reader 102*a* may be used to read a card associated with a player, such as a magnetic stripe card. RFID reader 102*b* may be any type of identity reader for reading an identifier of the player, such as data stored on an RFID fob. Biometric reader 102*c* may be a device that reads biometric data of the player, such as a fingerprint or retinal scan. Based on a determined identity of a player, device 101 may access one or more systems that store associated player information, such as resort server system 200. The player information may be used to control player access to the player terminal 100, control player account transactions, select a screen layout for the player, select player promotions, and perform additional functions consistent with the disclosed embodiments.

Input/output system 104 may include one or more input and/or output components, such as display 104*a* and input jack 104*b*. Additional input/output components may be used as well. Display 104*a* (e.g., a touchscreen display, LCD display with pushbutton control, etc.) may be used to receive input from the player (e.g., a PIN number, service request, etc.) and to display gaming and services information to the player. The display may include customized graphics related to the game machine, the casino, the device manufacturer, etc., and may employ any type of display technology (e.g., LCD, touchscreen, etc.). Headset input 104*b* may enable the player to connect a device, such as a headset unit 110 (e.g., a combined microphone and earphone unit), to enable voice communications via device 101. In one embodiment, headset input 104*b* permits a player to plug a wired headset unit 110 into player terminal 100. In another embodiment, a microphone and speaker may be built into device 101. In yet another embodiment, headset unit 110 may communicate wirelessly with device 101 using a wireless link (e.g., infrared link, RF link, Bluetooth-enabled device, etc.).

In one embodiment, device 101 includes a central processing system 106. Central processing system 106 may include one or more processors, RAM and ROM storage devices, data buses, appropriate software, and other computer components capable of implementing the systems and methods of the disclosed embodiments.

In certain embodiments, device 101 may further include handheld interface 112. Handheld interface 112 permits resort personnel or other individuals to access and/or configure player terminal 100. In one embodiment, handheld interface 112 may be configured to receive commands and/or other information from a handheld device 120. The commands and/or information may instruct central processing system 106 or another processing system on player terminal 100 to configure player terminal 100 (e.g., disable the terminal, reset the terminal, access play history, change terminal configuration, review terminal accounting data, etc.). Handheld interface 112 may be configured to communicate with handheld device 120 wirelessly (e.g., via Bluetooth, infrared, or other wireless link) or via a wired connection (e.g., USB or other connection).

Handheld device 120 may be any portable device that resort personnel or other individuals may use to access and/or configure player terminal 100. For example, handheld device 120 may be a personal digital assistant (PDA), laptop, or other portable device that includes an input/output system (e.g., LCD screen, touchscreen, pushbutton controls, etc.) configured to accept instructions from a user (e.g., to disable a gaming terminal, reset the terminal, access play history, etc.) and an interface system (e.g., wireless or wired communication port) configured to communicate with one or more player terminals. In one embodiment, handheld device 120 is configured to communicate directly with handheld interface 112 in order to configure player terminal 100 (e.g., via a wireless or temporary wired link). In another embodiment, handheld device 120 is configured to communicate with player terminal 100 via network 150 or another access point in communication with player terminal 100 (e.g., via a wireless or wired link to the network or access point). In another embodiment, handheld device 120 may communicate with a bank of gaming machines (e.g., via a game server). These embodiments permit a user in the vicinity of a player terminal 100 (e.g., within a viewable distance from the terminal) to configure the terminal via handheld device 120. Handheld device 120 may additionally include security measures that prevent non-authorized users from accessing gaming terminals 100 (e.g., encryption, password protection, biometric identification protection, etc.). In a further embodiment, handheld device 120 may communicate with a printer or storage system via a wired or wireless connection so that terminal information can be printed and/or stored electronically.

Device 101 may communicate with one or more server systems, such as resort server system 200, via network interface 108 and network 150. Network interface 108 may be any interface that enables communication over a network (e.g., Ethernet interface, wireless interface, etc.). Network 150 may be any network (e.g., the Internet, a local area network, wide area network, etc.) capable of providing communications between a player terminal and another entity (e.g., a server system, another player terminal, a wireless or other similar device, a resort employee, etc.), to provide enhanced gaming and services to a player at the player terminal.

The foregoing and the following examples are intended to be illustrative of the features of the present invention as opposed to limiting it in any manner. Moreover, systems, methods, and articles of manufacture consistent with the present invention are not limited to any particular resort, player, or employee. A resort may include, but is not limited to, hotels, motels, amusement parks, a hospitality facility, theme parks, restaurants, gaming parlors, airports, casinos, etc. A player may include, but is not limited to, a guest of a resort. An employee may include, but is not limited to, a patron or a person affiliated with a resort and who provides services to guests. In addition, although the elements and components of player terminals 100, handheld device 120, and server system 200 are depicted in some instances as separate units, the elements and components of player terminals 100, handheld device 120, and server system 200 may be separate units, or may be combined as single units (e.g., via a single hardware and/or software device) without departing from the scope of the disclosed embodiments.

Figure 1A:
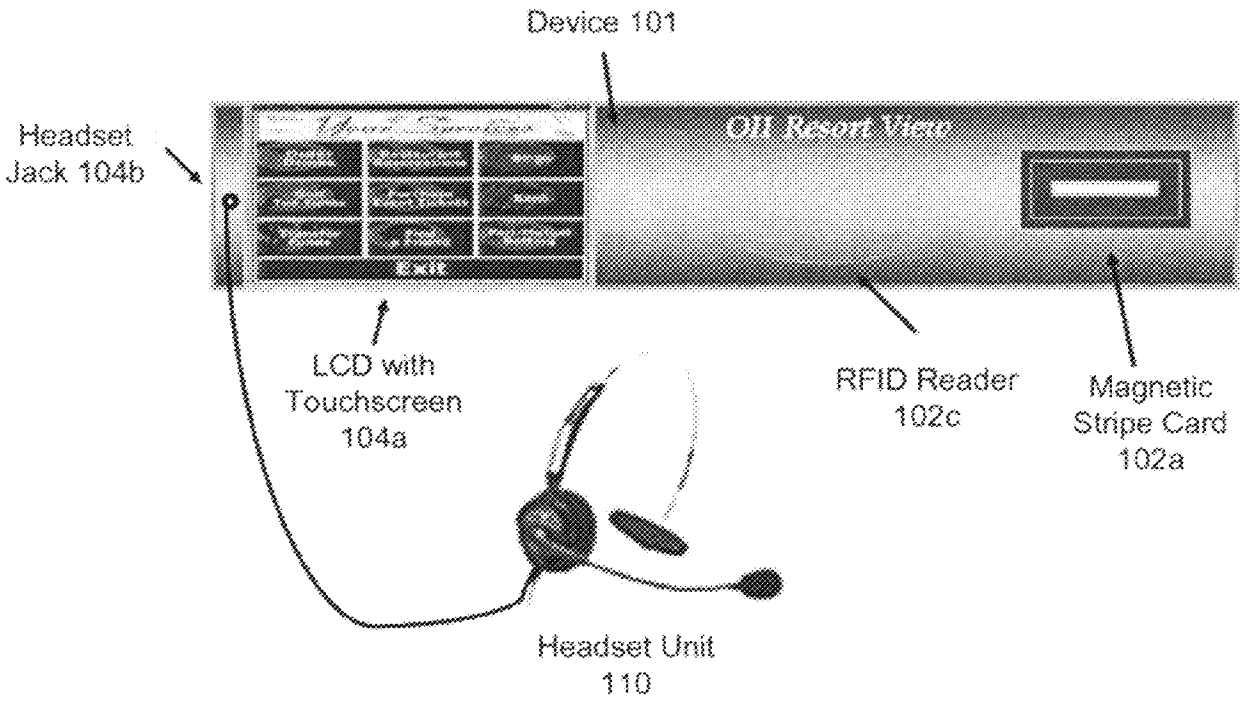
FIG. 1A is an illustration of an exemplary interface for a gaming terminal consistent with certain disclosed embodiments.

FIG. 1A is an illustration of an exemplary interface portion of device 101 consistent with certain disclosed embodiments. In the embodiment depicted in FIG. 1A, device 101 includes a headset jack 104*b*, an LCD with touchscreen display 104*a*, a headset unit 110 comprising a microphone and earphone, an RFID reader 102*c*, and a magnetic stripe card reader 102*a*. Display 104*a* may display one or more enhanced services available to the user, such as "Order Drinks," "Restaurant Reservations," "Bingo," "Golf Tee Times," etc. In one embodiment, device 101 may be retrofitted into existing player terminals. In other embodiments, device 101 may be built into player terminals during manufacture, or may be attached to player terminals in other ways.

Figure 2:
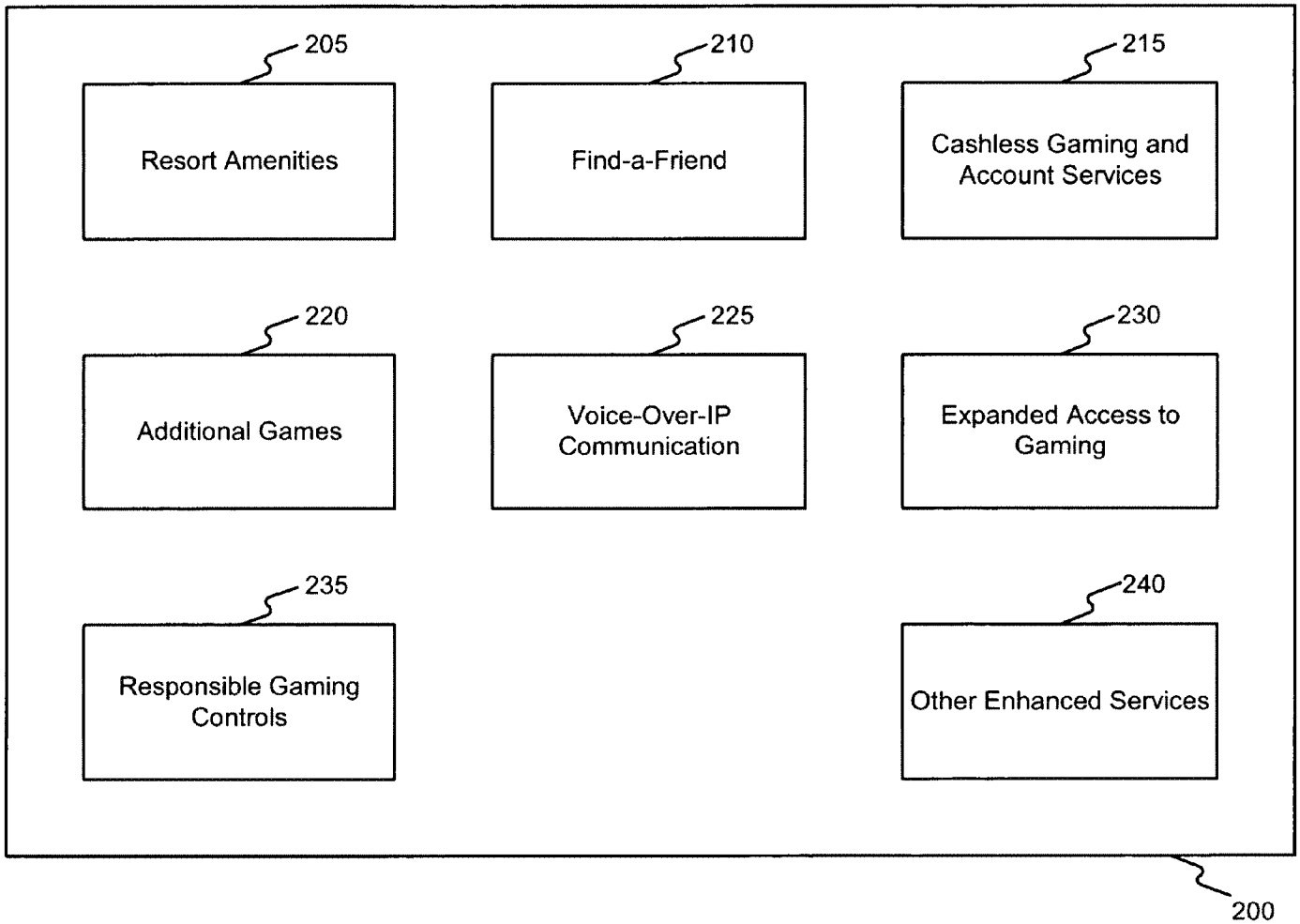
FIG. 2 is a block diagram of a server system for providing integrated gaming and services consistent with certain embodiments of the present invention.

FIG. 2 is a block diagram of a server system 200 for providing integrated gaming and services consistent with one or more disclosed embodiments. Server system 200 may be implemented using one or more computers using hardware and/or software that permits communication with player terminals 100 over a network, such as network 150, to provide enhanced gaming and services to players at player terminals. For example, enhanced gaming and services may include resort amenities 205, Find-a-Friend 210, cashless gaming and account services 215, additional games 220, voice-over-network communication 225 (e.g., voice-over-IP, etc.), expanded access to gaming 230, responsible gaming controls 235, and other enhanced services 240.

Resort amenities 205 include one or more services provided by a resort to its patrons. For example, resort amenities 205 may include shopping, sports, dining, room service, valet services, theater, access to gaming accounts, and other services. In one embodiment, a resort may include a casino that includes gaming terminals which provide players with access to additional resort amenities. A player may access a player terminal using his or her personal identification (e.g., via a transaction card, RFID fob, biometric data, etc.), and may then obtain access to one or more of the resort amenities 205 based on the player's identification. For example, a player logged on to a gaming terminal may, in addition to playing games on the terminal, order tickets, request room service, order food and drink, transfer funds between gaming accounts, etc.

Find-a-Friend 210 permits patrons and other guests and resort personnel to contact others through one or more terminals located throughout a resort. The resort may include a number of terminals and/or locations which may include a unique location identifier and receiving device. When a patron or other person enters or exits a location, the receiving device may receive an identification of the person (e.g., through a card reader, RFID device, etc.). By tracking the location of patrons and other resort personnel, friends or others within the resort may contact each other by voice communications, text messages, or other types of communication.

Cashless gaming and account services 215 allow players to play games (e.g., in a casino) without the need for coins or other cash. In one embodiment, a server system maintains accounts for different resort guests such that when a guest swipes a card or other identification device in a gaming terminal, a player's account is debited or credited based on amounts wagered and/or amounts won. In one embodiment, players may use any terminal in the resort using an identification device, such that monetary transactions may be carried out from any gaming terminal without the need for cash.

Additional games 220 may include access to gaming systems remotely (e.g., from offsite locations) such that a user may access one or more games (e.g., Bingo, Keno, e-Scratch, etc.) using his or her own computer, etc. In one embodiment, a player may enter wagers using a terminal at a resort that accepts the player's identification. After wagers are accepted, the user may log on to the resort system from home or from another offsite location to play one or more games, using the wagers already made. The player may later visit the resort to collect any money won.

Voice-over-network communication 225 permit players, resort guests, and other personnel to communicate by voice over a network. For example, players using player terminals may communicate with others at the resort using voice-over-IP or other types of communications. In one embodiment, each player may have an identification that may be used to register a location within the resort where the player is currently located. If another person wishes to contact the player, the person may make a telephone call (e.g., using voice-over-IP) or other voice communication to the registered location (e.g., a particular player terminal, a resort kiosk, etc.) of the player. Voice-over-network communications allow players and other personnel to speak with each other regardless of their location within the resort.

Expanded access to gaming 230 enables players with physical limitations or disabilities, such as vision impairment, to use a gaming terminal and to access services offered by the resort. For example, in one embodiment, expanded access to gaming 230 provides voice recognition and interactive voice response such that disabled players who, for example, cannot see a screen or cannot manually enter selections on a player terminal may still use the player terminal via audio or other communication. Expanded access to gaming 230 is described further below.

Responsible gaming controls 235 limit and control the amount of playing and/or money used by players at a resort. For example, players may first register for an account in order to play games at a resort. Authorized players may then be issued a card or other device that may be used to allow the player to log on to the resort system in order to play games. However, depending on the player's personal profile and/or other information, a player may be associated with certain rules that control the amount of gaming permitted by the player. For example, rules may limit the monetary amount spent by the player, may limit the amount of time spent playing one or more games, or may impose other restrictions on the player. Consequently, players may be prevented from excessive gambling or other activities that may be detrimental to the players' livelihood.

Figure 3A:
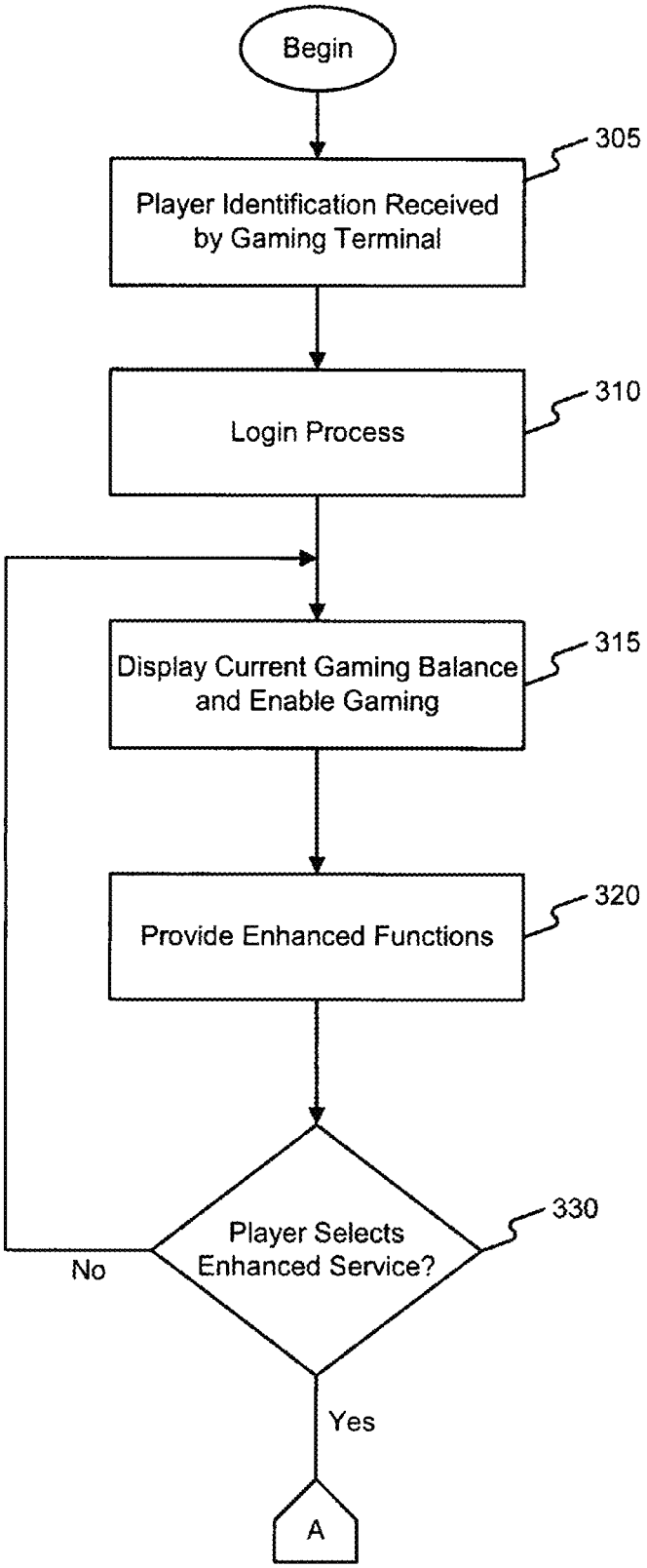
FIGS. 3A-3B are flowcharts of methods for providing integrated gaming and services consistent with certain embodiments of the present invention.
Figure 3B:
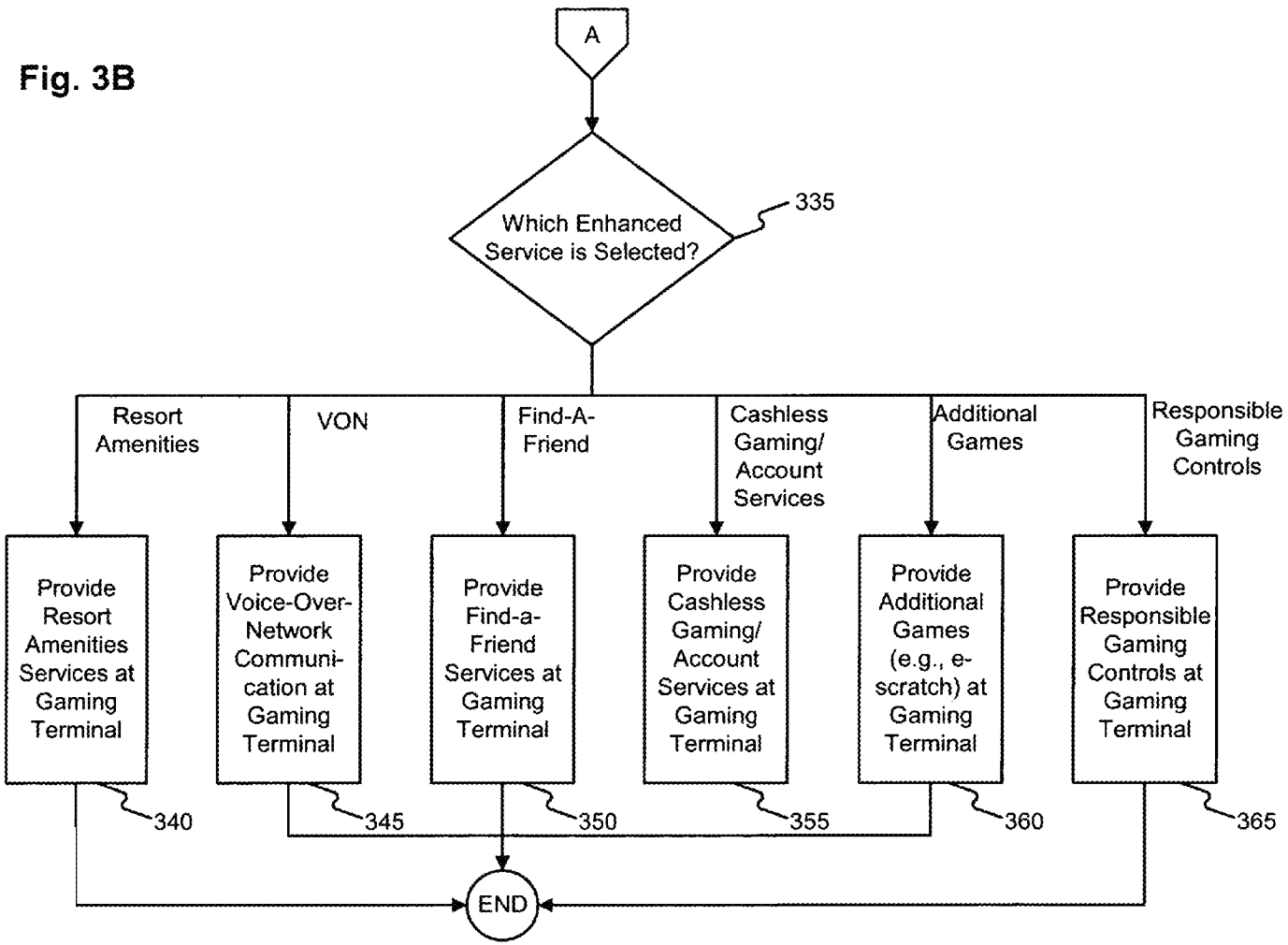

FIGS. 3A and 3B are flowcharts of a method for providing integrated gaming and services consistent with an embodiment of the present invention. In step 305, a new or existing account-based guest (e.g., a card holder) visiting a resort would utilize an account card or other identification device (e.g., magnetic stripe, smart card, RFID fob, biometric identifier, etc.) to log on to any of the gaming machines on the property having a device, such as device 101. As part of the logon process, in step 310, device 101 may present a customized greeting to the guest and/or prompt the guest to enter a personal identification number (PIN) or other security input on input/output system 104 (e.g., touchscreen pad, voice-activated headset system, pushbutton control, etc.) to initiate play. For example, device 101 may display a greeting on a display screen or announce a greeting via a speaker or headphone. In some embodiments (e.g., when using a biometric reader), a PIN input may not be necessary. In certain embodiments, automated responsible gaming controls may prohibit a player from successfully logging on. For example, a player who has exceeded his allotted playing time or who attempts to log in during prohibited hours may be blocked from successfully logging on at device 101. In one embodiment, device 101 uses the player identification information to access one or more player profiles stored in a database or other storage system. The player profiles, in addition to resort rules, gambling laws, and/or other guidelines, may be used to control player access to the player terminal 100. Device 101 may then provide a message (e.g., via display 104*a*, headset 110, etc.) alerting the player of his or her access status, and may permit player access as appropriate.

In one embodiment, once logged on, the guest's current gaming balance is displayed on display 104*a* (or provided to headset 110, etc.), and the player is permitted to use player terminal 100 for gaming and/or other functions (step 315). In certain embodiments, at the time of logging on, a guest may be eligible for promotional credits or elective promotional activities. Device 101 may then communicate the promotional information and permit a player to elect or select a promotional feature. Once elected, the player terminal balance may be updated to reflect the promotional balance, and the player may play using the promotional credits, may participate in the promotional play session, etc. In other embodiments, at log on and if enabled, player terminal 100 may provide customer-specific responsible gaming notifications and enforcements or stored messages from other patrons.

Once play has initiated, the display of device 101 may provide additional information and functions to the guest, such as resort amenities and services, point balances, Find-a-Friend, responsible gaming notifications and controls, and property marketing information (step 320). Additionally, asynchronous play awards, resort announcements, or play related incentives may be displayed using device 100. In certain embodiments, a player may have pre-selected a subset of available services that they wish to have displayed on device 100, or a casino may elect to offer certain services only to selected players. The menu options displayed on device 101 may be altered accordingly. For example, in one embodiment, players who wage large amounts may be offered premium amenities (e.g., VIP tickets to shows), while female patrons may be offered spa packages. Furthermore, certain services may be automatically activated, e.g., when a player logs on to a player terminal using device 101.

During play or at any point in the session, the player may select any of the enhanced services (step 330). For example, the player could choose to access resort amenities (step 340) or voice-over-network communication (step 345). The player may also select to communicate with other guests or friends through the Find-a-Friend or Chat-with-a-Friend capability (step 350). In one embodiment, the player may connect a headset (e.g., guest owned or provided by resort) and through a touchscreen or other interface, locate a friend and establish a voice over network connection. In another embodiment, a guest could select balance inquiry, balance transfer, or other account services (step 355) using device 101. In addition, during play or at any point in the session, a guest could escrow, reveal, or otherwise enable existing or new electronic games("e-scratch") for entertainment purposes or later reveal at home (step 360).

In one embodiment, device 101 may facilitate the use of responsible gaming controls (step 365). For example, device 101 may provide messages to a player to notify him or her, for example, whether a maximum play time has been reached or if a balance limit is near. At the conclusion of play (e.g., logout), RSVP functions or play-level and preference-based recommendations may be displayed to the guest.

For customers having limited range-of-motion, visual impairments, or other disabilities, exemplary devices consistent with the disclosed embodiments may offer voice-enabled game play, audio feedback and information, resort amenities, responsible gaming notifications, and other customer oriented services not normally available to physically limited customers. These services may be provided using, for example, voice recognition and interactive voice response (IVR) technologies and a headset such as headset 110.

In one embodiment, upon receiving voice commands, voice recognition software within the player terminal 100, a remote server, and/or device 101 may cause the voice commands to be executed by game software. For example, a player at a video black jack table speaking the words "hit me" may cause an additional card to be dealt to her hand. Alternatively, a player command to bet may be followed by a video or audio confirmation of the bet. For example, a player may speak the words "bet five dollars" and player terminal may display or recite "Confirm five dollar bet?" The patron may then speak "yes" or "no," or may select options using buttons or touch screen functionality. In one embodiment, confirmation may be performed for every voice command provided to device 101. In other embodiments, confirmation may be performed for a subset of commands, or, alternatively, for no commands.

Voice commands may enable physically challenged or immobile patrons to control the player terminal where they otherwise may not have the ability to play (e.g., a quadriplegic patron may not have the ability to press buttons or pull a slot machine handle, but may issue voice commands). Further, a player terminal may use voice-over-network hardware and/or software as well as text-to-voice hardware and/or software to cause information displayed on the display 104*a* to be recited through headphones 110 or other sound reproduction devices. This recitation of screen information may enable vision impaired patrons to play otherwise inaccessible games, by allowing such patrons to hear, instead of see, the results of their game and other information.

One skilled in the art will recognize that many alternative embodiments are possible within the scope of the present invention.

What is claimed is:

1. An integrated gaming and services system comprising:

a gaming terminal in a casino, comprising:

one or more electronic input devices configured to detect a physical item associated with a monetary value that establishes a credit balance and to receive a cashout input that initiates a payout from the credit balance, wherein the credit balance changes based on play of a wagering game;

a reader system connected to the gaming terminal and configured to read identification information of a player;

an input/output system including one or more input components that are configured to permit the player to provide input to cause game play action; and a communication interface connecting the gaming terminal to a communication network; and a server system in communication with the gaming terminal via the communication interface, the server system configured to:

provide enhanced services to the player based at least on the identification information of the player in response to receiving the identification information of the player, disable enhanced services to the player in response to not receiving the identification information of the player, wherein the enhanced services include voice-over-network communications and a service configured to track a location of a person in the casino and enable communication between the player and the person over a network between a different gaming terminal at the location and the gaming terminal where the player is to provide input to cause the game play action, and differentiate which of the enhanced services are provided based on information about the player.

2. The integrated gaming and services system of claim 1, wherein the reader system includes a card reader, an RFID reader, and a biometric identification reader.

3. The integrated gaming and services system of claim 1, wherein the input/output system includes a touchscreen display and at least one of: a headset having a microphone and an earphone, and a built-in microphone and speaker.

4. The integrated gaming and services system of claim 1, wherein the enhanced services include responsible gaming controls, voice recognition and interactive voice response services.

5. The integrated gaming and services system of claim 2, wherein the enhanced services include responsible gaming controls, voice recognition, interactive voice response services and cashless gaming.

6. The integrated gaming and services system of claim 3, wherein the enhanced services include responsible gaming controls, voice recognition and interactive voice response services.

7. The integrated gaming and services system of claim 1, further comprising:

a portable device configured to permit a user to configure and access information from the gaming terminal.

8. The integrated gaming and services system of claim 7, wherein the portable device is configured to communicate with the gaming terminal via one or more wireless links.

9. A method of providing integrated gaming and services to disabled players, comprising:

determining whether a player has provided an identification of the player using a gaming terminal in a casino based on one or more of: information received from a card, information received from an RFID signal, and biometric information, wherein the gaming terminal comprises one or more electronic input devices configured to detect a physical item associated with a monetary value that establishes a credit balance and to receive a cashout input that initiates a payout from the credit balance, wherein the credit balance changes based on play of a wagering game;

presenting, at the gaming terminal, the wagering game for play by the player;

after the player provided an identification:

providing, by the gaming terminal, gaming information to the player based at least in part on the identification of the player, selecting, in response to receiving the identification of the player, enhanced services comprising voice-over-network communications and a service configured to:

track a location of a person in the casino; and enable communication between the player and the person over a network between a different gaming terminal at the location and the gaming terminal that the player is using, wherein the selecting is based on information about the player, and providing to the player the enhanced service provided over a network by a server in communication with the gaming terminal; and after the player did not provide an identification, disabling the enhanced service during play of the wagering game.

10. The method of claim 9, further comprising:

providing additional enhanced services to the player based at least on the identification of the player.

11. The method of claim 10, wherein the additional enhanced services include one or more of: resort amenities, cashless gaming, additional games, and expanded access to gaming.

12. The method of claim 9, further including:

configuring the gaming terminal using a portable device.

13. The method of claim 12, further including:

configuring the gaming terminal using a wireless device located in the immediate vicinity of the gaming terminal.

14. An integrated gaming and services system comprising:

a gaming terminal located at a casino and configured to present a wagering game for play by a player, the gaming terminal comprising:

one or more electronic input devices configured to detect a physical item associated with a monetary value that establishes a credit balance and to receive a cashout input that initiates a payout from the credit balance, wherein the credit balance changes based on play of the wagering game, and an enhanced services device, wherein the enhanced services device comprises:

a reader system connected to the gaming terminal, the reader system configured to read identification information in order to determine the identification of the player, one or more output components that are configured to output gaming and services information to the player, and a communication interface connecting the gaming terminal to a communication network; and a server system in communication with the gaming terminal via the enhanced services device, the server system configured to provide enhanced services to the player based at least on the identification of the player determined by the enhanced services device, wherein the enhanced services comprise:

voice-over-network communications, a first service configured to track a location of a person in the casino and enable communication between the player and the person over a network between a different gaming terminal at the location and the gaming terminal where the player is presented the wagering game, and a second service configured to enable the player to place a wager on the wagering game at the gaming terminal, suspend the wagering game, and resume play of the wagering game on a remote device outside the casino, wherein resumed play is based on the wager placed at the gaming terminal.

15. The integrated gaming and services system of claim 14, wherein the input/output system includes a touchscreen display and at least one of: a headset having a microphone and an earphone, and a built-in microphone and speaker.

16. The integrated gaming and services system of claim 14, wherein the enhanced services include responsible gaming controls, voice recognition and interactive voice response services, and one or more of: resort amenities, Find-a-Friend, cashless gaming, additional games, and expanded access to gaming.

17. The integrated gaming and services system of claim 1, wherein the enhanced services comprise a service configured to enable the player to place a wager on the wagering game at the gaming terminal, to suspend the wagering game, and to resume play of the wagering game on a remote device outside the casino, wherein resumed play is based on the wager placed at the gaming terminal.

18. The method of claim 9, wherein the enhanced service comprise a service configured to enable the player to place a wager on the wagering game at the gaming terminal, to suspend the wagering game, and to resume play of the wagering game on a remote device outside the casino, wherein resumed play is based on the wager placed at the gaming terminal.

* * * * *